United States Patent [19]

Falge et al.

[11] Patent Number: 4,467,574

[45] Date of Patent: Aug. 28, 1984

[54] SECURITY DEVICE FOR BASEMENT WINDOWS

[76] Inventors: John J. Falge, 4696 NE. Townline Rd., Marcellus, N.Y. 13108; James A. Albanese, 310 Wheaton Rd., Syracuse, N.Y. 13203; Arthur W. Loran, 4667 Antoinette Dr., Marcellus, N.Y. 13108; E. Alan Locklin, 424 Sunrise Dr., Syracuse, N.Y. 13205

[21] Appl. No.: 262,510

[22] Filed: May 11, 1981

[51] Int. Cl.[3] ..... E04H 3/08

[52] U.S. Cl. ..... 52/106; 49/50

[58] Field of Search ..... 52/106, 127.5, 127.7, 52/127.12, 208, 202; 109/10, 15; 49/50, 57, 70

[56] References Cited

U.S. PATENT DOCUMENTS

| | | | |
|---|---|---|---|
| 199,879 | 1/1878 | Thomas | 52/106 |
| 2,351,991 | 6/1944 | McClain | 52/208 |
| 2,622,285 | 12/1952 | Roos | 52/202 |
| 3,507,229 | 4/1970 | MacDonald | 52/106 |
| 3,550,337 | 12/1970 | Lorenz | 52/208 |

*Primary Examiner*—James L. Ridgill, Jr.

[57] ABSTRACT

This security device for basement windows consists primarily of a pair of parallel spaced-apart bars secured over the window. It further includes carriage bolts extending through the concrete or cinder blocks, which also extend into a pair of channel members, and the bolts receive nuts that are enclosed in the channel members, and are rotated by a special off-set wrench, which is entered into an opening in a wall of the channel members.

3 Claims, 7 Drawing Figures

12
13
13a
14
15
11
2
10

12
15
17
4
14
18
11

18
19
20
10
13
13a
15
16
14
11

23
19
18
21
22
20
12
15

11
14
16
15
18
17
12
20
21
22
23
19

31

24
25
28
26
27
7
30
29

27
26
25
30
12
28

SECURITY DEVICE FOR BASEMENT WINDOWS

This invention relates to security devices, and more particularly, to a security device for basement windows.

It is, therefore, the principal object of this invention to provide a security device for basement windows, which will offer maximum security against burglars.

Another object of this invention is to provide a security device for basement windows, which will be of bar and channel construction, so as to prevent unlawful entry into a house, through a basement window.

Another object of this invention is to provide a security device for basement windows, which may be removed by the user, when desired.

A further object of this invention is to provide a security device for basement windows, which will employ the use of a wrench of unique design, to install or remove the device.

Other objects of the present invention are to provide a security device for basement windows, which is simple in design, inexpensive to manufacture, rugged in construction, easy to use and efficient in operation.

These, and other objects, will be readily evident, upon a study of the following specification, and the accompanying drawing, wherein.

Figure 1:
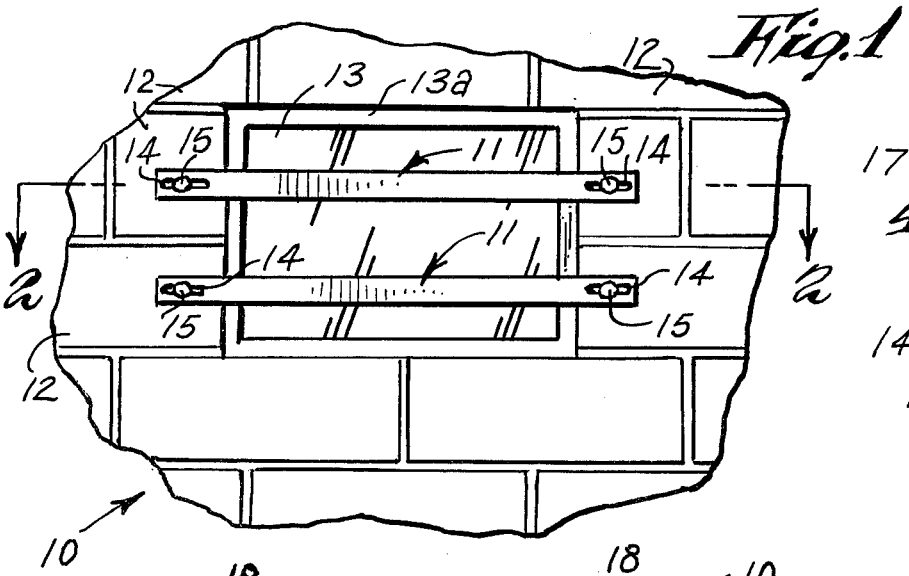
FIG. 1 is an exterior view of a basement window, showing the present invention installed thereon.
Figure 3:
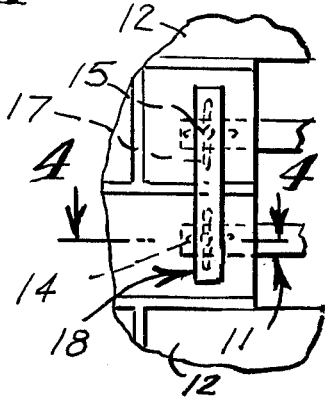
FIG. 3 is a fragmentary interior face view of the window of FIG. 1.
Figure 2:
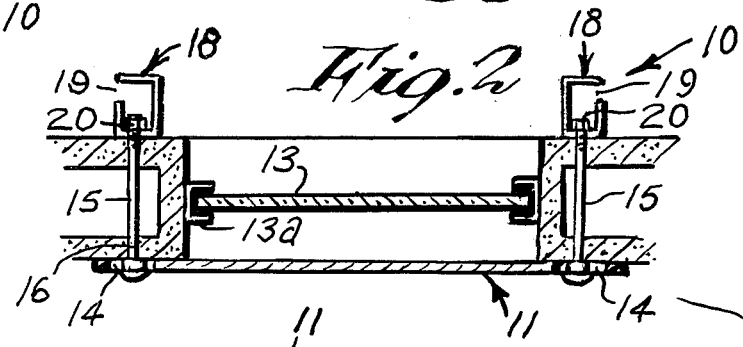
FIG. 2 is a cross-sectional view, taken along the line 2—2 of FIG. 1.
Figure 4:
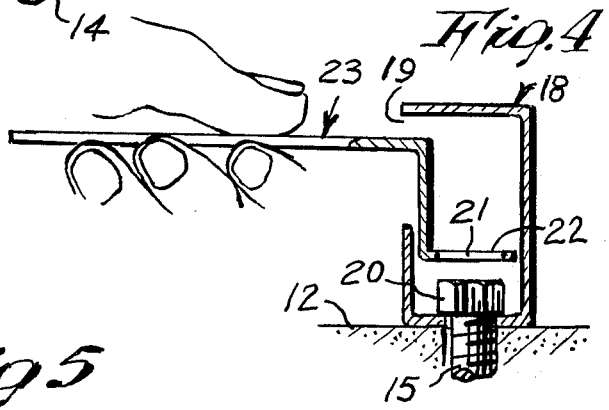
FIG. 4 is an enlarged view, taken on the line 4—4 of FIG. 3, and illustrates a special wrench, having access to the nut fastener on the inside of the channel member.
Figure 5:
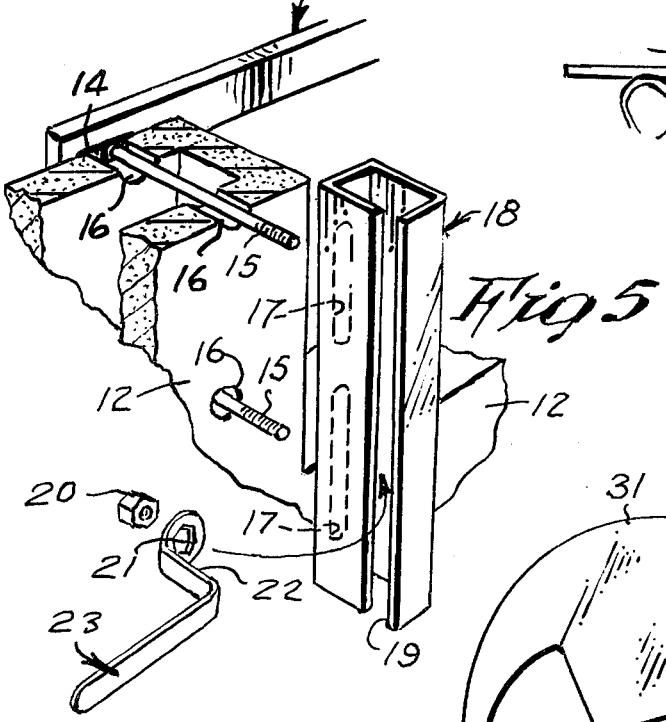
FIG. 5 is a fragmentary perspective view, showing one of the channel members, prior to being secured to one of the bar members, by means of the wrench.

According to this invention, a device 10 is shown to include a pair of flat parallel spaced-apart bars 11, of steel, which face against blocks 12, and are on the exterior of the window 13, defined by blocks 12. A slot 14, through each end of bars 11, freely receives a carriage bolt 15, and bolts 15 are freely received in opening 16, drilled through blocks 12, the threaded portions being freely received in a pair of slots 17, spaced apart in one side of a pair of channel members 18, which are rectangular in cross-sectional configuration, having an opening 19, that extends the length thereof, offset of a corner, for a purpose which hereinafter will be described.

Bolts 15 receive suitable nut fasteners 20, which are rotated, by being received in the suitable opening 21, of the off-set portion 22 of special wrench 23, the off-set portion 22 being entered into the openings 19 of the channel members 18.

It shall be noted, that the slots 14 serve as a means of preventing the heads of the standard carriage bolts 15 from rotating, when the nut fasteners 20 are rotated by wrench 23.

In use, openings 16 are first drilled in the blocks 12, so as to receive the carriage bolts 15, which have the square portions of their heads in the slots 14. The channels 18 are then aligned, so as to receive the shank portions of bolts 15, within the slots 17. The nut fasteners 20 are then entered in the openings 19, and placed upon the bolts 15, and the offset end 22, of the wrench 23, is entered into the openings 19 of the channels 18, and placed on the nut fasteners 20, so as to rotate them, to hold device 10 fast, over the window 13 and its frame 13a.

It shall also be recognized, that the present invention offers maximum security for basement windows, and the user can remove the bars at any time, with the use of the special wrench.

Further advantages are as follows:

(a) It is virtually impossible to remove from the outside, within a reasonable amount of time, because of the channels.

(b) From the inside, it may be removed in a matter of minutes, with the special wrench, to allow the home owner open use of the window.

(c) It offers greater strength than the conventional method of window bars, because it does not use lag bolts or anchors, which can become loose, or rot, if not used in wooden frames, or drilled partially into block or concrete.

Figure 6:
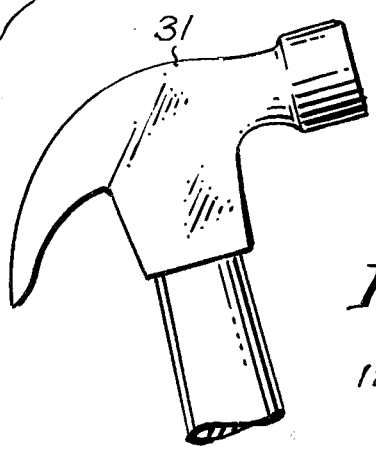
FIG. 6 is a fragmentary inside face view of a modified channel member, shown in elevation.
Figure 6:
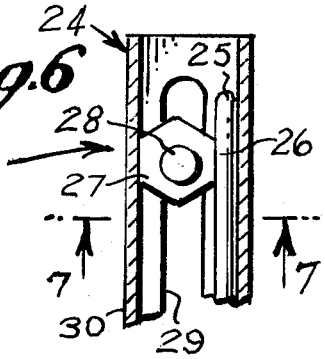
Figure 7:
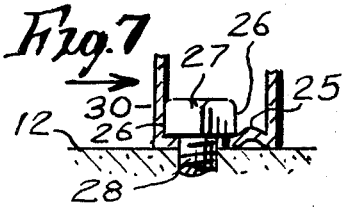
FIG. 7 is a cross-sectional view, taken along the line 7—7 of FIG. 6.

Referring now to FIGS. 6 and 7 of the drawing, a modified channel 24 includes a raised rib 25, against which a side face 26, of nut fastener 27, on bolt 28 in slot 29, rests. As shown in the drawing, the slot 29 is not located along a center of the channel web but is located slightly toward one side, in order that it be approximately midway between the rib and one of the channel side legs, thus permitting the nut fastener being jammed therebetween when tightened down hard, and prevent being rotated. Thus the channel cannot be shifted sideward if pounded on either opposite side legs thereof by a hammer 31 used in the hands of an unauthorized person trying to loosen the channel from the block wall.

In use, when the side wall 30 is hammered by hammer 31, side wall 30 will urge against one face 26 of nut fastener 27, and the opposite face 26 will be urged against rib 25, so as to additionally prevent nut fastener 27 from being turned by unauthorized persons.

While various changes may be made in the detail construction, it is understood that such changes will be within the spirit and scope of the present invention, as is defined by the appended claims.

What we now claim is:

1. A security device for basement windows, comprising, in combination, a pair of parallel, spaced-apart bars secured to the outer faces of blocks defining an opening in which a window and frame are secured, a pair of parallel, spaced-apart channel members secured to the inside faces of said blocks, a plurality of bolt fasteners and nut fasteners received in said channel members for securing said bars and said channel members to said blocks, and an offset wrench for tightening or loosining said nut fasteners.

2. The combination according to claim 1, wherein said bolt fasteners are received in an elongated slot near each end of said bars, and are freely received in openings through said blocks, square portions of heads of said bolt fasteners being embraced by sides of said elongated slots preventing said bolt fasteners from rotating when said wrench is rotating said nut fasteners on said bolt fasteners, and said pair of channel members each include a pair of spaced-apart elongated slots through an elongated web thereof, for freely receiving the threaded portions of said bolt fasteners.

3. The combination according to claim 2, wherein each said channel member comprises said elongated web being between one side edge of each of a pair of parallel elongated legs, and an elongated flange parallel to said web extending from an opposite side edge of the other said leg, said narrow opening receiving said nut fasteners therethrough for mounting on said bolt fasteners, and also receiving said wrench therethrough for tightening said nut fasteners on said bolt fasteners, in order to secure said device over said window opening.

* * * * *